US008740672B2

(12) United States Patent
Kawamata et al.

(10) Patent No.: US 8,740,672 B2
(45) Date of Patent: Jun. 3, 2014

(54) POWER TOOL

(75) Inventors: Takashi Kawamata, Hitachinaka (JP); Shigeyoshi Kobayashi, Ebina (JP)

(73) Assignee: Hitachi Koki Co., Ltd., Tokyo (JP)

( * ) Notice: Subject to any disclaimer, the term of this patent is extended or adjusted under 35 U.S.C. 154(b) by 198 days.

(21) Appl. No.: 13/337,991

(22) Filed: Dec. 27, 2011

(65) Prior Publication Data

US 2012/0171938 A1 Jul. 5, 2012

(30) Foreign Application Priority Data

Dec. 28, 2010 (JP) ..... 2010-291813

(51) Int. Cl.
*B24D 5/16* (2006.01)

(52) U.S. Cl.
USPC ..... 451/342; 451/359

(58) Field of Classification Search
USPC ..... 451/342, 344, 353, 359, 541, 548
See application file for complete search history.

(56) References Cited

U.S. PATENT DOCUMENTS

| | | | | |
|---|---|---|---|---|
| 2,666,307 | A * | 1/1954 | Higert | 464/92 |
| 3,040,485 | A * | 6/1962 | Tocci-Guilbert | 451/548 |
| 3,068,664 | A * | 12/1962 | Tocci-Guilbert | 464/89 |
| 3,392,616 | A * | 7/1968 | Hensley | 83/666 |
| 3,613,472 | A * | 10/1971 | Held | 74/391 |
| 4,674,234 | A * | 6/1987 | Reiling et al. | 451/342 |
| 4,905,772 | A * | 3/1990 | Honsa et al. | 173/162.1 |
| 5,560,348 | A * | 10/1996 | Markley et al. | 125/15 |
| 5,749,353 | A * | 5/1998 | Markley et al. | 125/20 |
| 6,663,481 | B2 * | 12/2003 | Nauche | 451/541 |
| 6,887,141 | B1 * | 5/2005 | Lin | 451/357 |
| 7,056,199 | B2 * | 6/2006 | Valentini | 451/357 |
| 8,147,297 | B2 * | 4/2012 | Hamm et al. | 451/353 |
| 8,231,438 | B2 * | 7/2012 | Kuhnle et al. | 451/359 |
| 2009/0156107 | A1 * | 6/2009 | Guenther et al. | 451/359 |

FOREIGN PATENT DOCUMENTS

| | | | |
|---|---|---|---|
| JP | 51-153893 | U | 12/1976 |
| JP | 3096194 | U | 6/2003 |
| JP | 2010-069604 | A | 4/2010 |

OTHER PUBLICATIONS

Japanese Office Action issued in Japanese Patent Application No. JP 2010-291813 dated May 21, 2013.

* cited by examiner

*Primary Examiner* — Eileen P. Morgan
(74) *Attorney, Agent, or Firm* — McDermott Will & Emery LLP

(57) ABSTRACT

The present invention provides a power tool in which the permanent set of an elastic member is suppressed and the vibration reduction effect is maintained over a long period of time. A rubber ring is disposed as the elastic member between a wheel washer mounted on a spindle and a substrate of a diamond wheel, and these are secured by a locknut screwed to a tip of the spindle. This rubber ring absorbs the vibrations applied to the diamond wheel at grinding work. A mounting hole of the substrate is mounted on a boss portion of the wheel washer with a clearance fit, and spring pins whose both ends are supported by the wheel washer and a portion of a holding plate in the locknut are inserted into insertion holes of the substrate and insertion holes of the rubber ring with a clearance fit.

11 Claims, 7 Drawing Sheets

POWER TOOL

CROSS-REFERENCE TO RELATED APPLICATION

The present application claims priority from Japanese Patent Application No. 2010-291813 filed on Dec. 28, 2010, the content of which is hereby incorporated by reference to this application.

TECHNICAL FIELD OF THE INVENTION

The present invention relates to a power tool with a wheel type (disc type) tip tool mounted at the tip of its output shaft such as a portable disc grinder, and in particular to a mounting structure for mounting the wheel type tip tool on the output shaft.

BACKGROUND OF THE INVENTION

In grinding work for flattening surfaces of concrete, stone materials or the like with a power tool such as an electric power tool, an air tool, or an engine tool including a disc grinder or a sander, a diamond wheel is used as the tip tool thereof. The diamond wheel is of wheel type (disc type) in which a plurality of diamond grindstones are fixed on a surface of a cup type substrate whose central portion is formed in a cup shape, and it is used after being mounted on the output shaft (spindle) of the power tool at the axial center of the substrate.

In the grinding work with the power tool like this, since the grinding is carried out while the diamond grindstone is pressed against a material to be ground, vibrations caused by shocks at the grinding are directly transmitted to a worker, and it is difficult to continue the work for a long period of time.

In view of this, for example, in a power tool disclosed in Japanese Registered Utility Model No. 3096194 (Patent Document 1), an elastic member is disposed at a mounting portion for a tip tool so as to absorb the shock occurring at the grinding work, thereby reducing the vibrations transmitted from the tip tool to the worker.

SUMMARY OF THE INVENTION

However, since the grinding work with the diamond wheel is carried out while the grinding wheel is moved from front to back and from side to side, the grinding wheel makes an entire contact in which it contacts the material to be ground at its entire surface and a partial contact in which it is inclined and contacts the material to be ground only at a part of its surface.

When the grinding wheel makes the entire contact with the material to be ground, since the grinding wheel axially moves along the output shaft, the entire elastic member is uniformly pressed by the substrate and is elastically deformed evenly. Thus, the elastic member is not largely deformed.

Contrarily, when the grinding is carried out in the state where the grinding wheel is in the partial contact with the material to be ground, since a substrate part of the grinding wheel contacts the elastic member in the state of being inclined with respect to the output shaft, the elastic member is not equally deformed, and only a part of the elastic member is largely deformed. Therefore, the permanent set is likely to occur in the elastic member.

When the permanent set occurs in the elastic member, the gap between the substrate part of the grinding wheel and the elastic member becomes larger. Therefore, this diminishes the vibration reduction effect by the elastic member and causes trouble such as the rattle of the grinding wheel during the grinding work.

The present invention has been made in view of the above-described problem, and an object thereof is to provide a power tool in which the vibration reduction effect can be maintained over a long period of time by suppressing the permanent set of the elastic member.

According one aspect of the present invention, a power tool includes: a motor as a power source; a spindle that is driven to rotate by the motor; an elastic member that is secured to the spindle; a tip tool that is connected to the elastic member; and a guiding member to guide the tip tool in a direction along the spindle.

The power tool according to the present invention may further include a wheel washer that is connected to the spindle. The elastic member is secured to the wheel washer, the guiding member is a pillar member that extends in the direction along the spindle, and the pillar member penetrates through the elastic member and the tip tool.

In the power tool according to the present invention, the spindle has a male thread portion formed thereon, a locknut having a female thread portion to be engaged with the male thread portion is provided, and the pillar member is connected to the locknut.

In the power tool according to the present invention, the wheel washer, the elastic member, the tip tool, the pillar member, and the locknut are integrally secured by the pillar member.

In the power tool according to the present invention, a plurality of the pillar members are provided around the spindle.

In the power tool according to the present invention, the elastic member is sandwiched between the wheel washer and the tip tool, the wheel washer has a projecting portion that extends toward the tip tool, and the projecting portion is configured to contact the tip tool when the elastic member is deformed.

According to another aspect of the present invention, a power tool has an output shaft for mounting a wheel type tip tool. The power tool includes: a wheel washer that is mounted on the output shaft; a holding plate that is mounted on the output shaft with a clearance between the holding plate and the wheel washer in an axial direction; a cylinder portion that is provided on one of the wheel washer and the holding plate; a substrate of the tip tool that is disposed between the wheel washer and the holding plate, the substrate being fitted at a mounting hole provided at an axial center thereof into the cylinder portion so as to be movable in the axial direction; an elastic member that is disposed between the wheel washer and the substrate; a locknut that is screwed to a tip of the output shaft, thereby securing the wheel washer, the holding plate, and the cylinder portion to the output shaft; and a pin member whose one end is supported by the wheel washer and whose other end is supported by the holding plate, the pin member penetrating through the substrate and the elastic member.

In the power tool according to the present invention, the holding plate and the locknut are integrally formed.

In the power tool according to the present invention, the pin member is a spring pin.

With the present invention, the tip tool secured to the elastic member is guided by the guiding member in the direction along the spindle. Therefore, it is possible to suppress the inclination of the tip tool that moves in the axial direction in response to the reactive force from the material to be ground at grinding work. By suppressing the inclination of the tip tool, excessive deformation of the elastic member is prevented, and the occurrence of the permanent set of the elastic member can be reduced. Accordingly, the permanent set of the elastic member is suppressed and the vibration reduction effect by the elastic member can be maintained over a long period of time.

BRIEF DESCRIPTIONS OF THE DRAWINGS

DESCRIPTIONS OF THE PREFERRED EMBODIMENTS

One embodiment of the present invention will now be described in detail with reference to the accompanying drawings.

Figure 1:
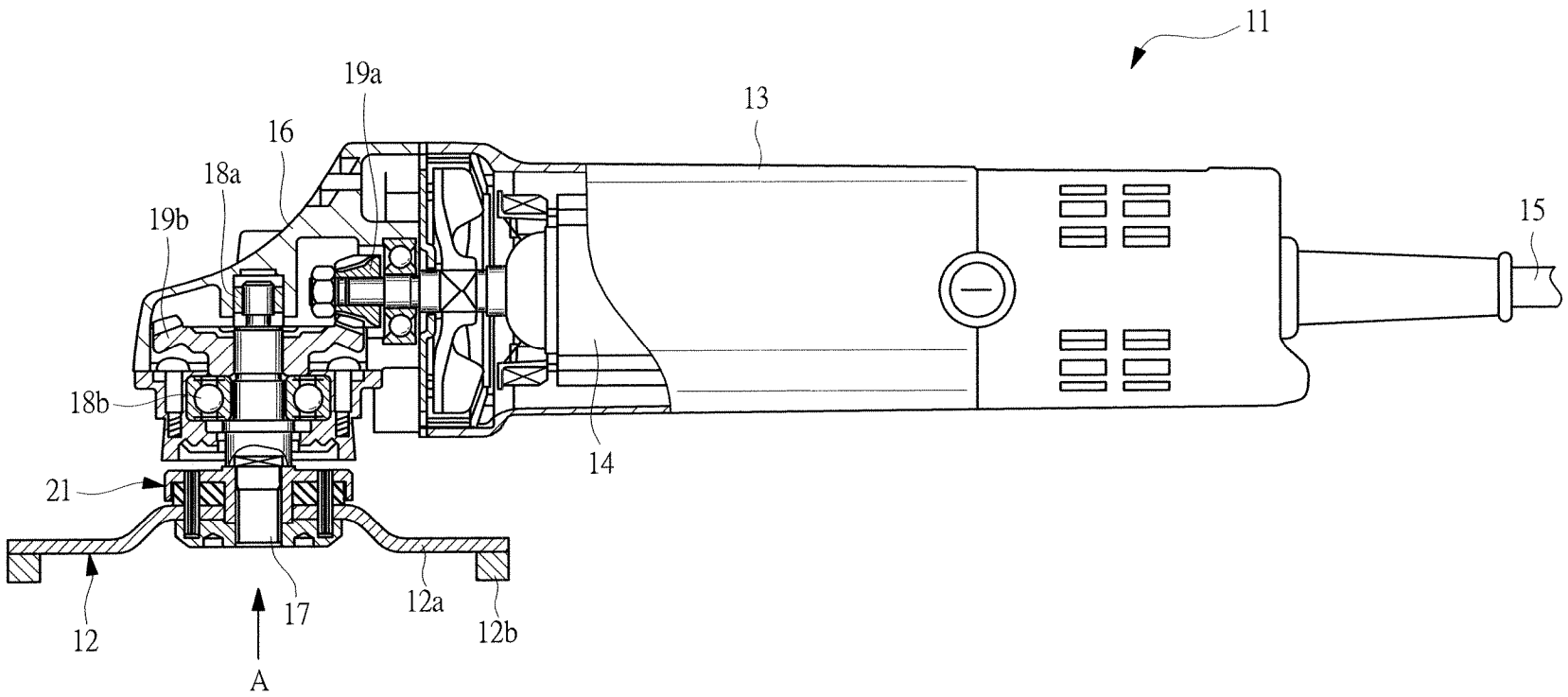
FIG. 1 is a partial cutaway view of a disc grinder according to one embodiment of the present invention.

A disc grinder 11 as a power tool shown in FIG. 1 is provided with a diamond wheel 12 as its tip tool, and is used for grinding work to flatten surfaces of concrete, stone materials, or the like.

The disc grinder 11 includes a body case 13 in cylindrical form, and the body case 13 houses an electric motor 14 as a driving source in its inside. The electric motor 14 is connected to a commercial power supply (not shown) via a power supply cord 15 which is extended from the body case 13, and the electric motor 14 is driven by electric power supplied from this commercial power supply.

A gear case 16 is attached to a tip portion of the body case 13. In this gear case 16, a spindle 17 as an output shaft is rotatably supported by a pair of bearings 18*a* and 18*b*. The spindle 17 is disposed perpendicular to the axial direction of the electric motor 14, and a tip portion thereof projects outward from the gear case 16. In the gear case 16, a pair of bevel gears 19*a* and 19*b* engaged with one another is provided, and the rotation of the electric motor 14 is turned by 90 degrees and transmitted to the spindle 17 by these bevel gears 19*a* and 19*b*.

Figure 2B:
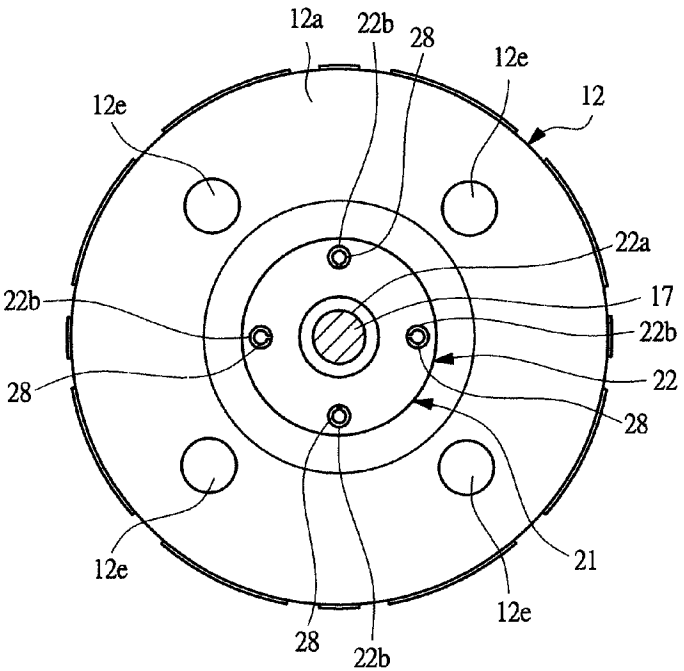
FIG. 2B is a bottom view of the mounting structure for the tip tool in FIG. 1.
Figure 2A:
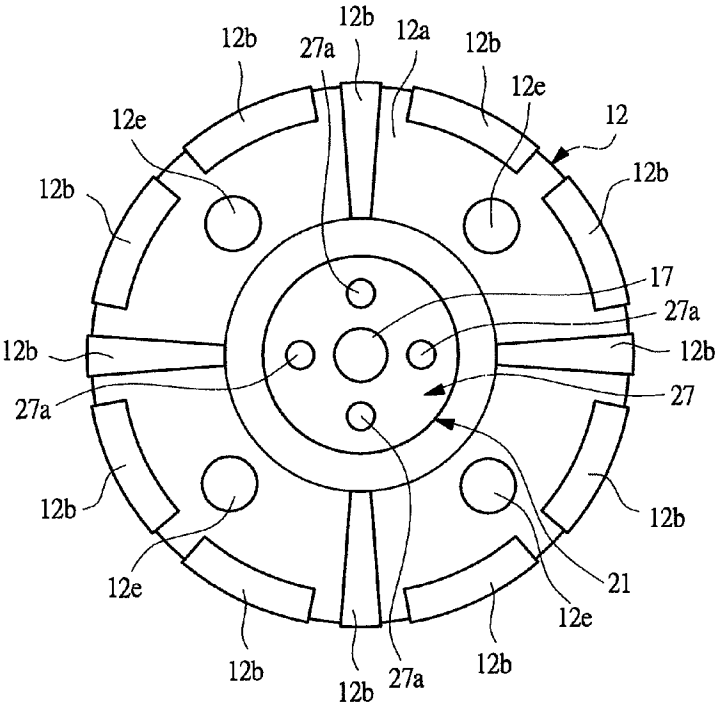
FIG. 2A is a plan view of a mounting structure for a tip tool as viewed along arrow A in FIG. 1.
Figure 3:
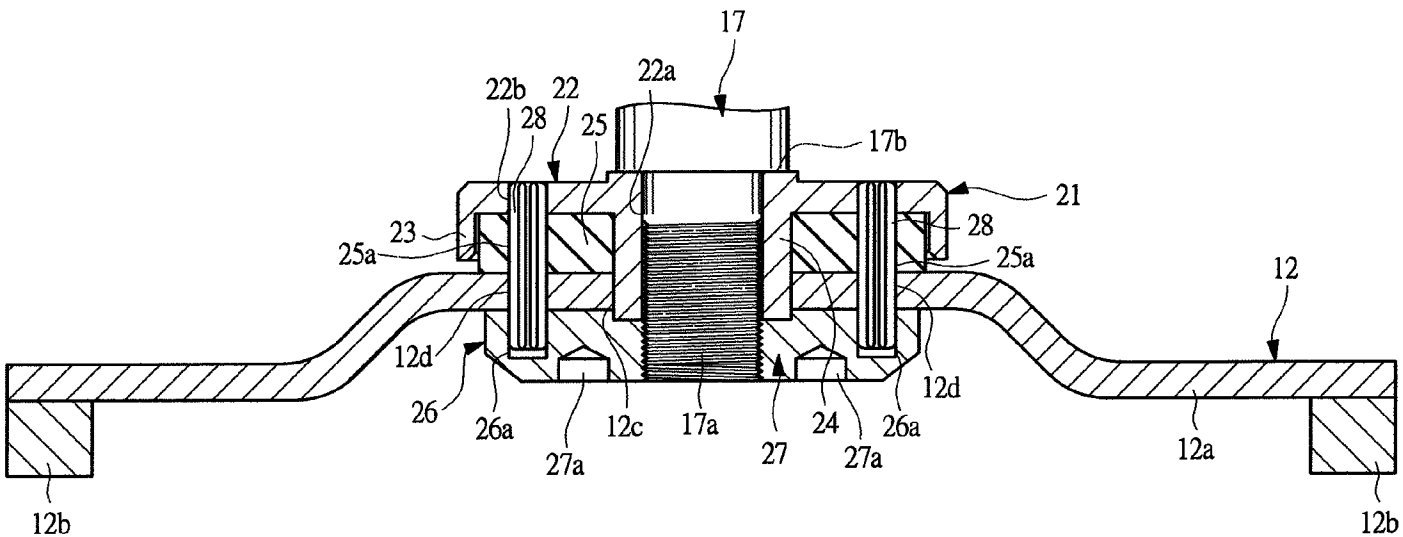
FIG. 3 is a vertical cross-sectional view of the mounting structure for the tip tool shown in FIG. 1.

As shown in FIGS. 2A and 2B, the diamond wheel 12 is provided with a substrate 12*a* formed in a disc shape and made of a steel plate. The diamond wheel 12 is of wheel type (disc type) in which a plurality of predetermined shaped diamond grindstones 12*b* are fixed to a surface of the substrate 12*a* by means of adhesion or the like. As shown in FIG. 3, the substrate 12*a* has a central portion formed in a cup shape concaved in the axial direction, that is, the diamond wheel 12 is a cup type wheel. The substrate 12*a* has a mounting hole 12*c* at the axial center in the cup shaped portion, and the diamond wheel 12 is mounted on the spindle 17 at the mounting hole 12*c* with a mounting structure 21 for the tip tool according to the present invention (hereinafter referred to as mounting structure 21). Also, the substrate 12*a* has four through holes 12*e* arranged at equal intervals in a circumferential direction. These through holes 12*e* are provided to eject grinding swarf of the material to be ground (concrete) or the like from between the material to be ground and the substrate 12*a*.

When an operating section of an electric power switch (not shown) of the disc grinder 11 is operated, the electric power is supplied to the electric motor 14, and the electric motor 14 starts operating. When the electric motor 14 starts operating, the spindle 17 is driven to rotate by the electric motor 14, and the diamond wheel 12 is rotated together with the spindle 17. Then, the rotating diamond wheel 12 is pressed against surfaces of a material to be ground such as concrete, stone materials or the like, thereby carrying out the grinding work to flatten the surfaces of the material to be ground. At this time, since a portion of the mounting structure 21 that projects to the side of the material to be ground with respect to the substrate 12*a* is disposed inside the cup shape of the substrate 12*a*, the entire surface of the diamond wheel 12 can be pressed against the surface of the material to be ground.

Next, the mounting structure 21 according to the present invention will be described in detail.

Figure 4:
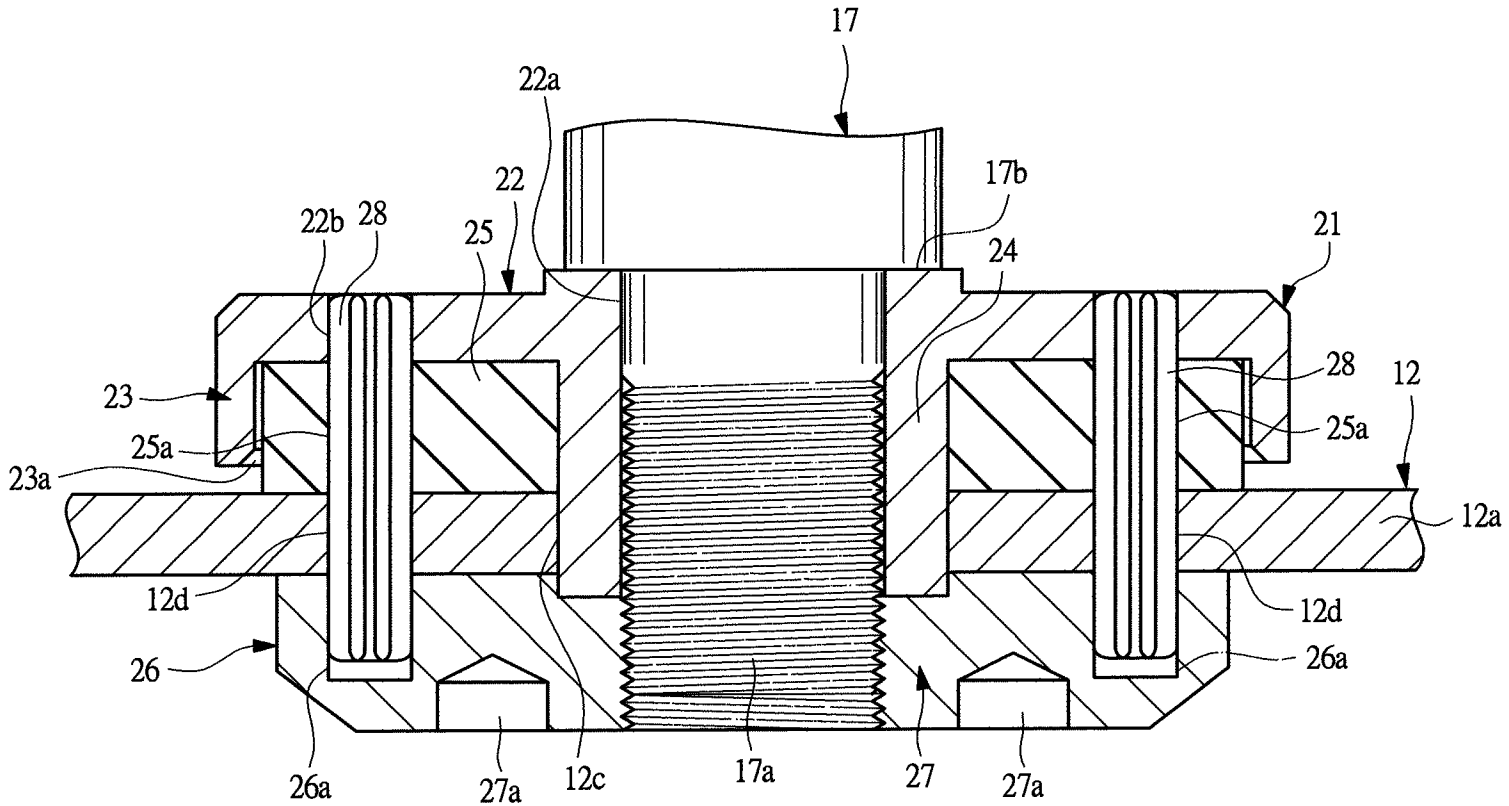
FIG. 4 is an enlarged cross-sectional view of the main section of FIG. 3.

As shown in FIG. 4, a wheel washer (flange) 22 is mounted on the spindle 17. The wheel washer 22 is made of steel or the like in a disc form, and the spindle 17 is inserted into a through hole 22*a* at the axial center of the wheel washer 22. The spindle 17 includes at its tip portion a male thread portion 17*a* whose diameter is slightly smaller, and the wheel washer 22 is disposed at the seating face 17*b* which is formed at the root of the male thread portion 17*a*. The wheel washer 22 is locked to the spindle 17 with a whirl-stop (not shown) so as to rotate together with the spindle 17.

A stopper cylinder 23 as a projecting portion is provided integrally with the wheel washer 22 at the outer peripheral end thereof, and a boss portion 24 as a cylinder portion is provided integrally with the wheel washer 22 at the inner peripheral end thereof. Each of the stopper cylinder 23 and the boss portion 24 is formed as a cylindrical wall that is coaxial with the wheel washer 22, and axially projects from the wheel washer 22 toward a tip side of the spindle 17. A projection height of the boss portion 24 from the wheel washer 22 is set higher than a projection height of the stopper cylinder 23 from the wheel washer 22, and the boss portion 24 is supported by the male thread portion 17*a* of the spindle 17 on its inner periphery.

A rubber ring 25 as an elastic member is disposed inside an annular groove portion whose bottom portion corresponds to a surface of the wheel washer 22 formed between the stopper cylinder 23 and the boss portion 24. The rubber ring 25 is made of a rubber material and is formed in circular ring shape having a rectangular cross section. A thickness dimension of the rubber ring 25 in its axial direction is set larger than a height dimension of the stopper cylinder 23 in its axial direction, so that the rubber ring 25 projects more than the stopper cylinder 23 in the axial direction.

The stopper cylinder 23 has a cutout in its inner peripheral portion at the tip portion, and a cutout portion 23*a* is formed. The cutout portion 23*a* is formed in order to make smooth the portion of the rubber ring 25 in contact with the stopper cylinder 23 when the rubber ring 25 is compressed. In this manner, it is possible to reduce the occurrence of a crack in the rubber ring 25 when the rubber ring 25 is deformed to contact the cutout portion 23*a*.

The diamond wheel 12 is mounted on the spindle 17 by fitting the mounting hole 12*c* at its axial center on the outer periphery of the boss portion 24 with a clearance fit. When the substrate 12*a* is mounted on the spindle 17, the rubber ring 25 is disposed between the substrate 12*a* and the wheel washer 22.

A locknut 27 which is integrally formed with a holding plate 26 is screwed to the tip of the male thread portion 17*a* of the spindle 17 in order to secure the wheel washer 22 and the boss portion 24 to the spindle 17 and to hold the diamond wheel 12 between the wheel washer 22 and the locknut 27. The locknut 27 has four concave portions 27*a* arranged at equal intervals in a circumferential direction, and a convex portion of a dedicated jig (not shown) is engaged with each of the concave portions 27*a*. The locknut 27 is screwed to the male thread portion 17*a* with this dedicated jig until the locknut 27 abuts to the boss portion 24, and the boss portion 24 is sandwiched between the seating face 17*b* and the locknut 27 so as to secure the wheel washer 22 to the spindle 17. Accordingly, the holding plate 26 integrally provided with the locknut 27 is disposed spaced from the wheel washer 22 in the axial direction with using the boss portion 24 as the cylinder portion as a spacer.

Although the boss portion 24 as the cylinder portion is integrally formed with the wheel washer 22 in this embodiment, this should not be construed in a limiting sense. For example, the boss portion 24 as the cylinder portion may be integrally formed with the locknut 27, and the boss portion 24 may be sandwiched between the wheel washer 22 and the locknut 27 by forming the boss portion 24 as an individual part that is separated from the wheel washer 22 and the locknut 27.

When the locknut 27 is screwed to the male thread portion 17*a*, the substrate 12*a* is pressed by the locknut 27, and the rubber ring 25 is held in the state of being sandwiched and compressed between the substrate 12*a* and the wheel washer 22.

As shown in FIGS. 2A and 23, in the wheel washer 22, four supporting holes 22*b* which axially penetrate through the wheel washer 22 are provided at equal intervals in the circumferential direction. A spring pin 28 as a guiding member (pin member) is inserted into each of these supporting holes 22*b*. These spring pins 28 are pillar members that extend in a direction along the spindle 17, and the spring pins 28 each have a C-shaped cross section whose outer diameter is a little larger than an inner diameter of the supporting holes 22*b*. The spring pins 28 are force-fitted into the supporting holes 22*b* while shortening the outer diameter thereof. Accordingly, each spring pin 28 is supported in a state of being fixed at its one end to the wheel washer 22.

Four supporting holes 26*a* which correspond to the supporting holes 22*b* of the wheel washer 22 and are oriented in the axial direction are arranged at equal intervals in the circumferential direction in a portion of the holding plate 26 in the locknut 27. The other end of each spring pin 28 whose one end is supported by the wheel washer 22 is inserted into the corresponding supporting hole 26*a* provided in the portion of the holding plate 26 in the locknut 27. An inner diameter of the supporting hole 26*a* is set to be a little smaller than the outer diameter of the spring pin 28, and the other end of each spring pin 28 is force-fitted into the corresponding supporting hole 26*a* while shortening the outer diameter thereof. Accordingly, each spring pin 28 is supported in a state of being fixed at its other end to the portion of the holding plate 26 in the locknut 27. The axial direction of each spring pin 28 whose both ends are supported by the wheel washer 22 and the portion of the holding plate 26 in the locknut 27 is parallel to the axial direction of the spindle 17.

As described above, in this embodiment, the locknut 27 is integrally formed with the holding plate 26 that supports the spring pins 28, and it thus functions also as the holding plate 26.

On the other hand, four insertion holes 12*d* which correspond to each spring pin 28 and are oriented in the axial direction are arranged at equal intervals in the circumferential direction in the substrate 12*a* of the diamond wheel 12. Similarly, four insertion holes 25*a* which correspond to each spring pin 28 and are oriented in the axial direction are arranged at equal intervals in the circumferential direction in the rubber ring 25.

Each spring pin 28 whose both ends are fixed to (supported by) the wheel washer 22 and the portion of the holding plate 26 in the locknut 27 is inserted into the corresponding insertion hole 12*d* so as to penetrate through the substrate 12*a* and is inserted also into the corresponding insertion hole 25*a* so as to penetrate through the rubber ring 25. The inner diameters of the insertion holes 12*d* and 25*a* are set to be a little larger than the outer diameter of the spring pin 28 in a state of being force-fitted into the supporting hole 22*b* of the wheel washer 22 and the supporting hole 26*a* of the locknut 27. That is, the substrate 12*a* and the rubber ring 25 are in a state of clearance fit with the spring pin 28, and are thus movable relative to the spring pin 28 in the axial direction. Each spring pin 28 which is supported by the wheel washer 22 is inserted into the insertion hole 12*d* of the substrate 12*a*, so that the rotation of the substrate 12*a* relative to the wheel washer 22 is locked by the spring pin 28. That is, the spring pin 28 functions also as a whirl-stop, which locks the rotation of the diamond wheel 12 relative to the wheel washer 22.

In this structure, since the diamond wheel 12 is supported by the wheel washer 22 via the rubber ring 25, the vibrations caused by shocks applied to the diamond wheel 12 at grinding work can be absorbed by the elastic deformation of the rubber ring 25. Accordingly, the vibrations transmitted to a worker at the grinding work can be reduced to enhance its workability.

Further, since the spring pins 28 whose both ends are supported by the wheel washer 22 and the portion of the holding plate 26 in the locknut 27 are each inserted into the substrate 12*a* and the rubber ring 25, the occurrence of the permanent set of the rubber ring 25 is suppressed, and the vibration reduction effect by the rubber ring 25 can be maintained over a long period of time. In the following, the point that the excessive deformation of the rubber ring 25 is prevented by preventing the inclination of the diamond wheel 12 at grinding work by using the mounting structure 21 according to the present invention, so that the permanent set of the rubber ring 25 can be suppressed will be described based on FIGS. 5A, 5B, and 6.

As shown in FIG. 4, in the unloaded state where the diamond wheel 12 does not contact the material to be ground, the substrate 12*a* is pressed by the rubber ring 25 and abuts to the portion of the holding plate 26 in the locknut 27 on its one end face in the axial direction. Also, there is a clearance between the substrate 12*a* of the diamond wheel 12 and the tip of the stopper cylinder 23.

Figure 5A:
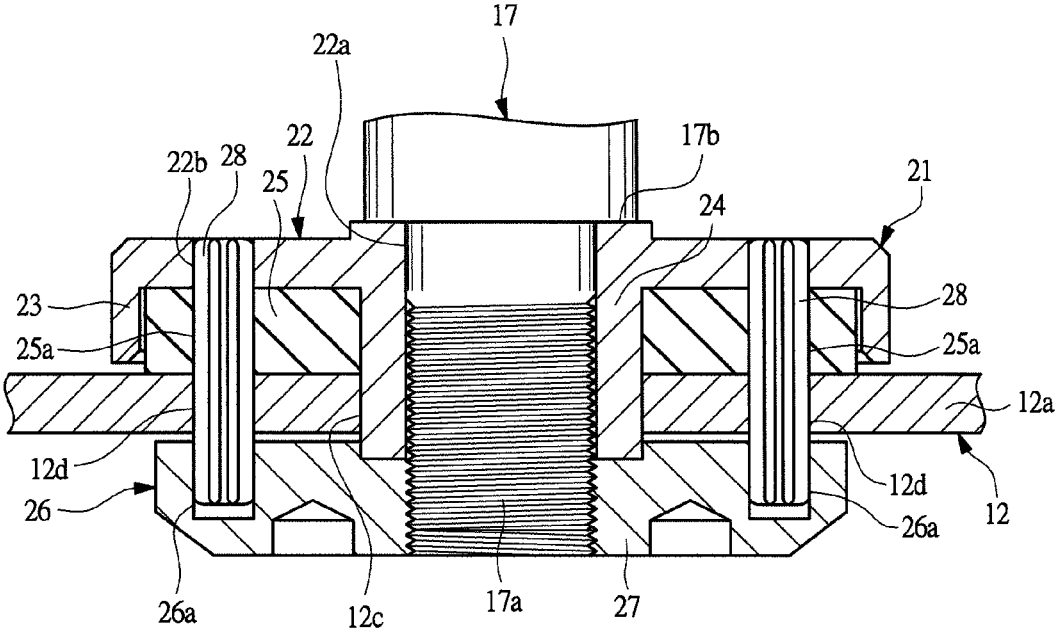
FIG. 5A is a cross-sectional view showing the state of the mounting structure during grinding work.

As shown in FIG. 5A, when the diamond wheel 12 is pressed parallel to the surface of the material to be ground and the grinding work is carried out in the state of entire contact, the diamond wheel 12 moves along the spindle 17 by the reactive force of the pressing load applied from the material to be ground, while being kept parallel to the surface of the material to be ground, and a clearance is provided between the substrate 12*a* and the portion of the holding plate 26 in the locknut 27.

At this time, the rubber ring 25 disposed between the wheel washer 22 and the substrate 12*a* is pressed by the substrate 12*a* and is compressed in the axial direction, but since the diamond wheel 12 moves in the axial direction while being kept parallel to the surface of the material to be ground, the entirety of the rubber ring 25 is uniformly pressed by the substrate 12*a*. Accordingly, large deformation only at a part of the rubber ring 25 does not occur.

When the diamond wheel 12 makes the entire contact and the pressing load thereof becomes excessive, the substrate 12*a* moves to a position further from the locknut 27 than the position shown in FIG. 5A, and the rubber ring 25 is further compressed.

Figure 5B:
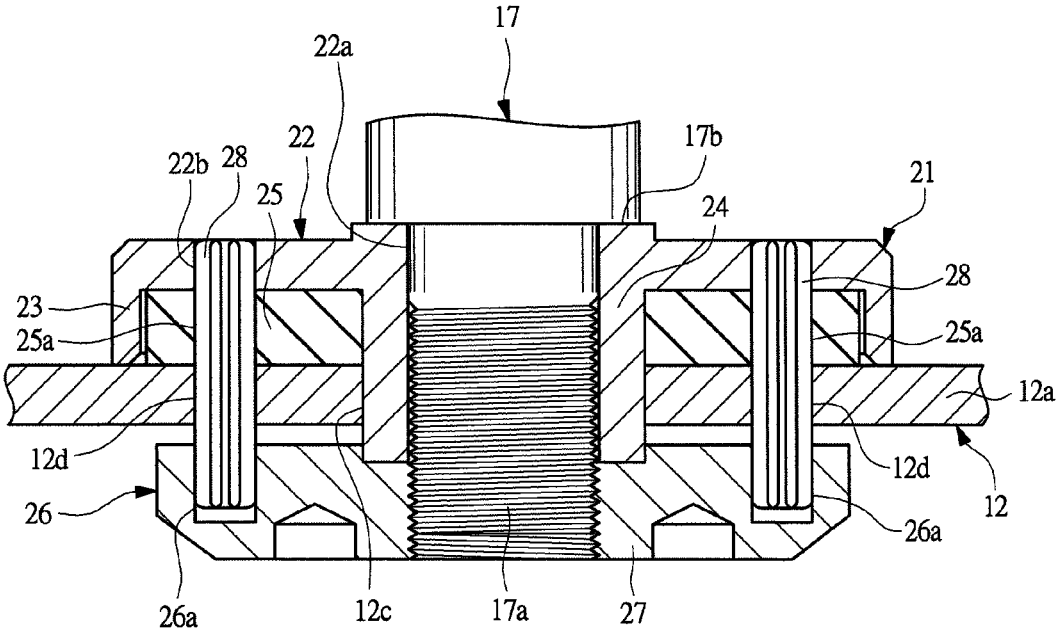
FIG. 5B is a cross-sectional view showing the state where the pressing load of the diamond wheel is excessive.

In this case, when the pressing force of the diamond wheel 12 exceeds a predetermined value, as shown in FIG. 5B, the substrate 12*a* abuts to the tip of the stopper cylinder 23 provided on the wheel washer 22, and a further movement of the diamond wheel 12 in the axial direction is restricted. Thus, even if the excessive pressing load is applied to the diamond wheel 12 at the grinding work, the excessive compression (deformation) of the rubber ring 25 is prevented. Accordingly, since the excessive deformation of the rubber ring 25 is prevented, the permanent set of the rubber ring 25 is suppressed.

On the other hand, when the grinding work is carried out in the partial contact state in which the diamond wheel 12 is pressed against the material to be ground only at a part of its surface, the reactive force in an inclined direction with respect to the axial direction of the spindle 17 is applied from the material to be ground to the diamond wheel 12.

In the mounting structure 21 of the present invention, however, the mounting hole 12*c* of the substrate 12*a* is mounted on the boss portion 24 of the wheel washer 22 with a clearance fit, and the spring pins 28 whose both ends are supported by the wheel washer 22 and the portion of the holding plate 26 in the locknut 27 are inserted into the substrate 12*a* with a clearance fit. Therefore, it is possible to prevent the inclination of the diamond wheel 12.

When the reactive force in the inclined direction with respect to the axial direction of the spindle 17 is applied, the substrate 12*a* of the diamond wheel 12 moves away from the locknut 27 and moves in the radial direction relative to the spindle 17 by an amount of the clearance of the clearance fit of the mounting hole 12*c* and the insertion hole 12*d*. When the substrate 12*a* moves in the radial direction, the inner periphery of the mounting hole 12*c* abuts to the outer periphery of the boss portion 24 of the wheel washer 22, and the inner periphery of each insertion hole 12*d* abuts to the outer periphery of the corresponding spring pin 28. Accordingly, since the diamond wheel 12 that makes the partial contact with the material to be ground is supported at a plurality of points in contact with the boss portion 24 and each spring pin 28, the inclination with respect to the spindle 17 can be prevented.

When the inclination of the diamond wheel 12 is prevented, since excessive deformation only at a part of the rubber ring 25 by the substrate 12*a* does not occur, the excessive deformation of the rubber ring 25 is prevented. Accordingly, even when the diamond wheel 12 makes the partial contact with the material to be ground, since the excessive deformation of the rubber ring 25 is prevented, the permanent set of the rubber ring 25 is suppressed.

Even when the diamond wheel 12 makes the partial contact with the material to be ground, if the excessive pressing load is applied, the substrate 12*a* abuts to the tip portion of the stopper cylinder 23 in the same manner as that shown in FIG. 5B, and the movement of the diamond wheel 12 or the substrate 12*a* is restricted, so that the excessive compression (deformation) of the rubber ring 25 is prevented.

As described above, with the present invention, since the pin member having one end that is supported by the wheel washer and the other end that is supported by the holding plate penetrates through the substrate and the elastic member, when the tip tool axially moves in response to the reactive force from the material to be ground at grinding work, the substrate is guided in the mounting hole toward the cylinder portion and the pin member functions as a guide, so that the inclination of the tip tool is suppressed. The suppression of the inclination of the tip tool prevents the elastic member from being excessively deformed. This reduces the occurrence of the permanent set of the elastic member. Accordingly, the permanent set of the elastic member is suppressed and the vibration reduction effect by the elastic member can be maintained over a long period of time. Specifically, in the mounting structure 21 of the present invention, the mounting hole 12*c* of the substrate 12*a* is mounted on the boss portion 24 of the wheel washer 22 with a clearance fit, and the spring pins 28 whose both ends are supported by the wheel washer 22 and the portion of the holding plate 26 in the locknut 27 are inserted into the substrate 12*a* with a clearance fit. Therefore, the inclination of the diamond wheel 12 is suppressed and thus the excessive deformation only at a part of the rubber ring 25 is prevented, so that the permanent set of the rubber ring 25 can be prevented. Accordingly, in the mounting structure 21 of the present invention, the permanent set of the rubber ring 25 is suppressed, and the vibration reduction effect by the rubber ring 25 of the mounting structure 21 can be maintained over a long period of time.

In the mounting structure 21 of the present invention, since the holding plate 26 which supports the spring pin 28 is integrally formed with the locknut 27, the number of components can be reduced and the reduction in the manufacturing cost of the mounting structure 21 can be achieved.

In the structure in which the holding plate 26 is integrally formed with the locknut 27, the mounting structure 21 can be unitized in the state of being mounted on the substrate 12*a*. That is, by force-fitting the spring pins 28, the wheel washer 22 and the locknut 27 can be held in an assembled state in which the substrate 12*a* and the rubber ring 25 are sandwiched therebetween. Accordingly, the mounting structure 21 is unitized by mounting it on the substrate 12*a* of the diamond wheel 12 in advance, and when the diamond wheel 12 is mounted on the disc grinder 11, the mounting structure 21 is screwed to the spindle 17. In this manner, the mounting work can be facilitated.

In the mounting structure 21 of the present invention, the spring pins 28 are used as pin member. This facilitates the mounting work of the spring pins 28 into the supporting holes 22*b* of the wheel washer 22 and the supporting holes 26*a* of the holding plate 26 and also the insertion work of the spring pins 28 into the insertion holes 12*d* of the substrate 12*a* and the insertion holes 25*a* of the rubber ring 25. As a result, the reduction in the manufacturing cost of the mounting structure 21 can be achieved.

Figure 6A:
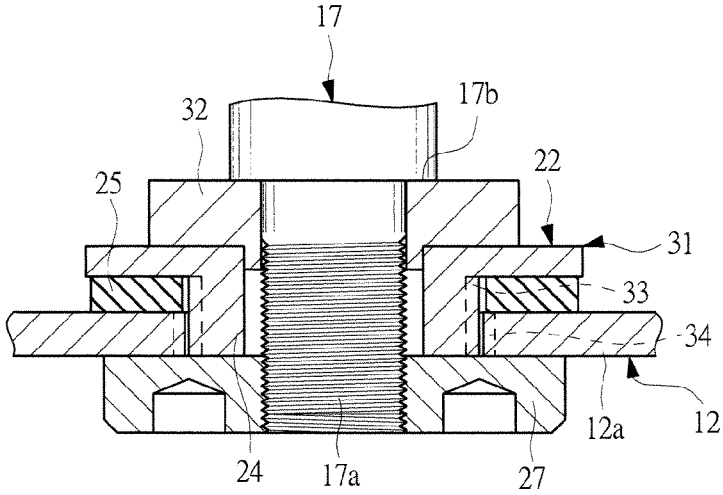
FIG. 6A is a cross-sectional view of a comparative example provided with no spring pin in which no load is applied.
Figure 6B:
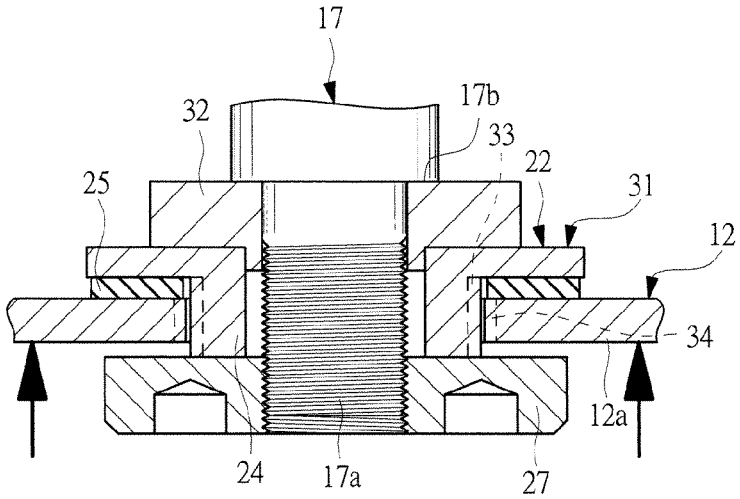
FIG. 6B is a cross-sectional view of the comparative example in which the diamond wheel makes the entire contact with the material to be ground.
Figure 6C:
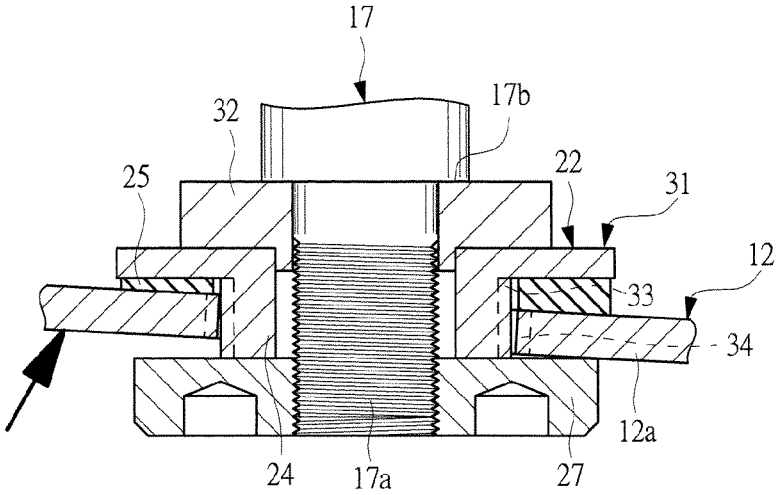
FIG. 6C is a cross-sectional view of the comparative example in which the diamond wheel makes the partial contact with the material to be ground.

Next, a mounting structure 31 in which the spring pins 28 whose both ends are supported by the wheel washer 22 and the portion of the holding plate 26 in the locknut 27 and which penetrate through the substrate 12*a* and the rubber ring 25 are not provided will be described as a comparative example based on FIGS. 6A, 6B, and 6C. In FIGS. 6A, 6B, and 6C, the same reference numerals are applied to the members corresponding to those described above for ease of comparison.

FIG. 6A shows the mounting structure 31 of the comparative example in an unloaded state. A sub-washer 32 is mounted on the spindle 17 and the sub-washer 32 abuts to the seating face 17*b*. The wheel washer 22 is disposed over the sub-washer 32 in the axial direction and is mounted on the spindle 17.

The boss portion 24 is integrally provided at the inner peripheral end of the wheel washer 22, and a whirl-stop 33 to the diamond wheel 12 is provided on the outer periphery of the boss portion 24.

The diamond wheel 12 is mounted on the boss portion 24 of the wheel washer 22 at the mounting hole 12*c* provided at the axial center of the substrate 12*a*. A whirl-stop 34 is provided on the inner periphery of the mounting hole 12*c* of the substrate 12*a*. When the diamond wheel 12 is mounted on the boss portion 24, the whirl-stop 34 is loosely engaged with the whirl-stop 33 provided on the outer periphery of the boss portion 24. Splines are used as these whirl-stops 33 and 34, and the whirl-stops 33 and 34 make the diamond wheel 12 movable relative to the boss portion 24 in the axial direction and locked in the rotational direction.

The rubber ring 25 is disposed between the wheel washer 22 and the substrate 12*a*.

The wheel washer 22 is sandwiched between the sub-washer 32 and the locknut 27 screwed to the male thread portion 17*a* of the spindle 17 and is secured to the spindle 17. When the locknut 27 is tightened, the substrate 12*a* is pressed by the locknut 27, and the rubber ring 25 is sandwiched between the substrate 12*a* and the wheel washer 22 and is held in a compressed state.

As shown in FIG. 6B, in the mounting structure 31 shown as the comparative example, when the diamond wheel 12 makes the entire contact with the material to be ground, the diamond wheel 12 axially moves, and the vibrations caused by the shocks applied to the diamond wheel 12 at grinding work can be absorbed by the elastic deformation of the rubber ring 25.

However, as shown in FIG. 6C, due to the reactive force in an inclined direction with respect to the axial direction of the spindle 17, the substrate 12*a* is inclined with respect to the spindle 17 with using a contacting portion of the inner periphery of the substrate 12*a* and the outer periphery of the boss portion 24 as the fulcrum until the lower surface of the substrate 12*a* contacts the locknut 27.

As described above, in the mounting structure 31 of the comparative example, when the diamond wheel 12 makes the partial contact with the material to be ground, since the substrate 12*a* is inclined and the excessive deformation of the rubber ring 25 is unavoidable, the permanent set of the rubber ring 25 occurs early. Accordingly, the gap between the substrate 12*a* and the rubber ring 25 becomes larger, and the vibration reduction effect by the rubber ring 25 is diminished early, so that trouble such as a rattle of the diamond wheel 12 occurs in the grinding work.

Figure 7:
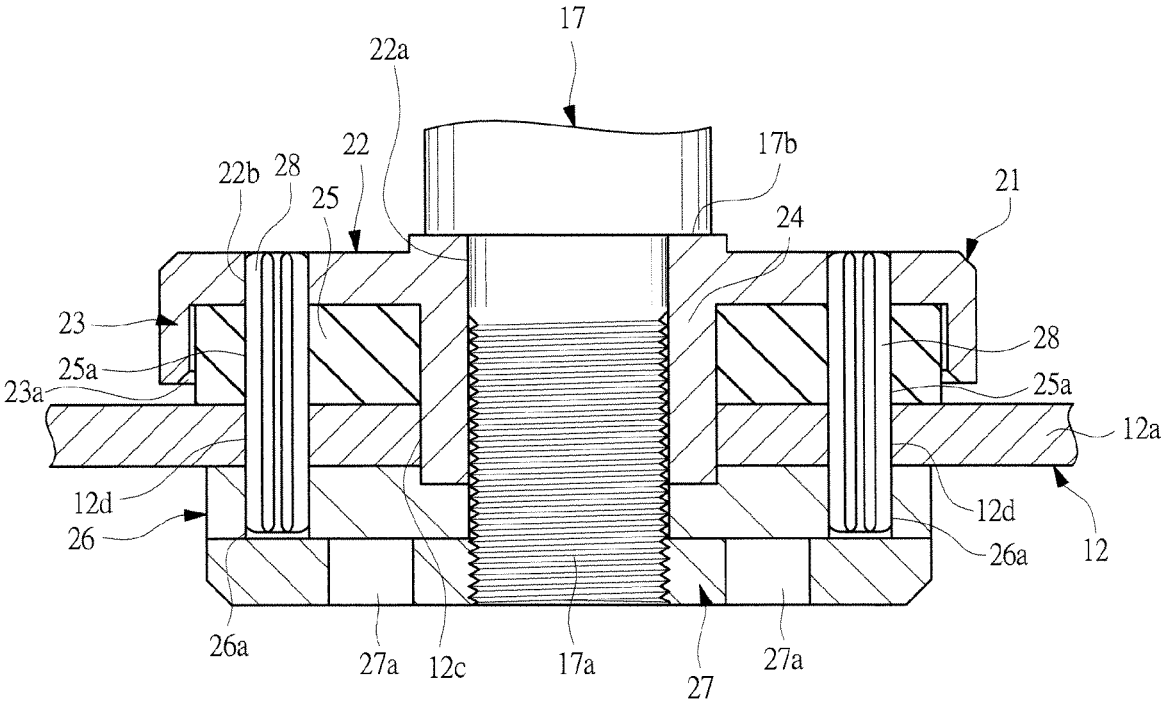
FIG. 7 is a cross-sectional view of a modification example of the mounting structure shown in FIG. 4.

FIG. 7 is a cross-sectional view of a modification example of the mounting structure shown in FIG. 4.

In the case shown in FIG. 4, the holding plate 26 which supports the spring pin 28 is integrally formed with the locknut 27. Contrarily, in the modification example shown in FIG. 7, the holding plate 26 is formed separately from the locknut 27.

In this case, the holding plate 26 is mounted on the male thread portion 17*a* of the spindle 17 with a clearance fit and is sandwiched and secured between the locknut 27 screwed to the male thread portion 17*a* and the boss portion 24. In this modification example with the structure described above, since a position of the holding plate 26 in the rotational direction can be set at any position regardless of a screwed amount of the locknut 27 to the male thread portion 17*a*, alignment of the supporting holes 26*a* of the holding plate 26 to the supporting holes 22*b* of the wheel washer 22 mounted on the spindle 17 is facilitated.

It goes without saying that the present invention is not limited to the embodiment described above and various modifications are possible without departing from the spirit and scope of the invention. For example, in the embodiment described above, the electric power tool including the electric motor 14 as the driving source is disclosed as the power tool to which the present invention is applied. However, this should not be construed in a limiting sense. For example, the mounting structure 21 of the present invention may be applied also to power tools using other driving sources (motor) such as an air tool using compressed air (air motor) as the driving source and an engine tool using an engine as the driving source.

In the embodiment described above, the spring pins 28 are used as the guiding member (pin member), but this should not be construed in a limiting sense. For example, round bars may be used as the pin member, and these round bars may be force-fitted into the supporting holes 22*b* of the wheel washer 22 and the supporting holes 26*a* of the holding plate 26. A cross section of the guiding member (pin member) is not limited to a circular cross section and may be of any shape.

Further, in the embodiment described above, the rubber ring 25 made of a rubber material is used as the elastic member, but this should not be construed in a limiting sense. For example, the member made of urethane, sponge material, or the like may be used insofar as the member has elasticity. Also, the shape of the elastic member is not limited to the circular ring with the rectangular cross section. For example, the elastic member may have another shape such as a circular ring with the circular cross section insofar as the elastic member is disposed between the wheel washer 22 and the substrate 12*a* to absorb the vibrations of the substrate 12*a*.

Furthermore, in the embodiment described above, the diamond wheel is used as the tip tool, but this should not be construed in a limiting sense. For example, the mounting structure 21 of the present invention may be applied to the mounting of other tip tools such as a resinoid wheel, sanding disc, wire brush and polishing disc.

What is claimed is:

1. A power tool, comprising:

a motor as a power source;

a spindle that is driven to rotate by the motor;

a wheel washer having an upper and lower surface that is coaxially mounted on the spindle;

an abrasive tip tool that is coaxially mounted on the spindle and driven by the motor via the spindle, the tip tool having an upper and lower surface;

an elastic member that is positioned between the upper surface of the tip tool the lower surface of the wheel washer;

a locknut that is mounted on the spindle so that the wheel washer is fixed to the spindle; and a guiding pillar member that extends from the wheel washer to the locknut by penetrating through the tip tool and allows the tip tool to be moved in a direction along the spindle.

2. The power tool according to claim 1, wherein the spindle has a male thread portion formed thereon, and the locknut has a female thread portion to be engaged with the male thread portion.

3. The power tool according to claim 2, wherein the wheel washer and the locknut are fixed to each other by the pillar member.

4. The power tool according to claim 1, wherein the guiding member is a plurality of pillar members which are provided around the spindle and each of which is parallel to the spindle.

5. The power tool according to claim 1, wherein the wheel washer has a projecting portion that extends along the spindle, and the projecting portion prevents the tip tool from being excessively inclined with respect to the spindle by contacting the tip tool when the elastic member is deformed by a pressing load on the tip tool.

6. The power tool according to claim 1, further comprising:

a holding plate that is mounted on the output shaft with a clearance between the holding plate and the wheel washer in an axial direction;

a cylinder portion that is provided on one of the wheel washer and the holding plate;

a substrate of the tip tool that is disposed between the wheel washer and the holding plate, the substrate being fitted at a mounting hole provided at an axial center thereof into the cylinder portion so as to be movable in the axial direction; and a locknut that is screwed to a tip of the output shaft, thereby securing the wheel washer, the holding plate, and the cylinder portion to the output shaft.

7. The power tool according to claim 5, wherein the holding plate and the locknut are integrally formed with each other.

8. The power tool according to claim 6, wherein the pin member is a spring pin.

9. An abrasive tip tool assembly provided with a mounting structure for a spindle of a power tool, comprising:

a wheel washer having an upper and lower surface that is coaxially mounted on the spindle;

an abrasive tip tool substrate that is coaxially mounted on the spindle and driven by a motor via the spindle, the tip tool having an upper and lower surface;

an elastic member that is positioned between the upper surface of the tip tool the lower surface of the wheel washer;

a locknut that is mounted on the spindle so that the wheel washer is fixed to the spindle; and a guiding pillar member that extends from the wheel washer to the locknut by penetrating through the tip tool and allows the tip tool to be moved in a direction along the spindle.

10. The tip tool according to claim 9, wherein the guiding pillar members are connected to the locknut.

11. The tip tool according to claim 9, wherein the guiding pillar members are pillar spring pins that extend from the wheel washer to the locknut by penetrating through the elastic member and the substrate.

* * * * *